US007278556B2

(12) United States Patent
Goujon et al.

(10) Patent No.: US 7,278,556 B2
(45) Date of Patent: Oct. 9, 2007

(54) FLUID PRODUCT DISPENSING VALVE AND FLUID PRODUCT DISPENSING DEVICE COMPRISING SAME

(75) Inventors: David Goujon, Saint Léger du Bourg Denis (FR); Jean-Marc Pardonge, Saint Ouen (FR)

(73) Assignee: Valois S.A., Le Neubourg (FR)

( * ) Notice: Subject to any disclaimer, the term of this patent is extended or adjusted under 35 U.S.C. 154(b) by 0 days.

(21) Appl. No.: 10/498,309

(22) PCT Filed: Dec. 11, 2002

(86) PCT No.: PCT/FR02/04291

§ 371 (c)(1),
(2), (4) Date: Apr. 25, 2005

(87) PCT Pub. No.: WO03/050013

PCT Pub. Date: Jun. 19, 2003

(65) Prior Publication Data

US 2005/0173466 A1 Aug. 11, 2005

(30) Foreign Application Priority Data

Dec. 13, 2001 (FR) ..... 01 16151

(51) Int. Cl.
*B65D 83/00* (2006.01)

(52) U.S. Cl. ..... 222/402.1; 222/402.2

(58) Field of Classification Search ..... 222/402.1, 222/402.2, 401.1, 401.2
See application file for complete search history.

(56) References Cited

U.S. PATENT DOCUMENTS

| | | | | |
|---|---|---|---|---|
| 3,169,525 | A * | 2/1965 | Bowen | 128/200.23 |
| 4,116,370 | A * | 9/1978 | Spitzer et al. | 222/402.18 |
| 4,349,135 | A | 9/1982 | Busselet | |
| 5,037,012 | A * | 8/1991 | Langford | 222/402.2 |
| 5,593,069 | A * | 1/1997 | Jinks | 222/246 |
| 5,632,421 | A * | 5/1997 | Colombo | 222/402.2 |
| 6,170,717 | B1 * | 1/2001 | Di Giovanni et al. | 222/402.2 |
| 6,296,156 | B1 * | 10/2001 | Lasserre et al. | 222/402.1 |
| 6,315,173 | B1 * | 11/2001 | Di Giovanni et al. | 222/402.2 |
| 6,318,603 | B1 * | 11/2001 | Burt | 222/402.1 |
| 6,345,740 | B1 * | 2/2002 | Riebe | 222/402.1 |
| 6,474,513 | B2 * | 11/2002 | Burt | 222/402.1 |
| 6,510,969 | B2 * | 1/2003 | Di Giovanni et al. | 222/402.2 |
| 6,644,306 | B1 * | 11/2003 | Riebe et al. | 128/200.23 |

FOREIGN PATENT DOCUMENTS

DE 2622211 A1 * 12/1976

(Continued)

*Primary Examiner*—Frederick C. Nicolas
(74) *Attorney, Agent, or Firm*—Sughrue Mion Pllc.

(57) ABSTRACT

Fluid product dispensing valve, comprising a valve body (10), a valve stem (20) moving in said valve body (10) between a rest position and a dispensing position, and an annular ring (30) mounted around said valve body (10), characterised in that said annular ring (30) is attached to said valve body (10), said attachment being substantially radially non-clamping onto said valve body (10), said annular ring (30) comprising an axial edge that is proximal with respect to outlet orifice of said valve stem (20), said annular ring (30) comprising one or more attachment means (35) co-operating with the valve body (10) and provided on or close to said proximal radial edge.

19 Claims, 2 Drawing Sheets

FOREIGN PATENT DOCUMENTS

Figure 1:
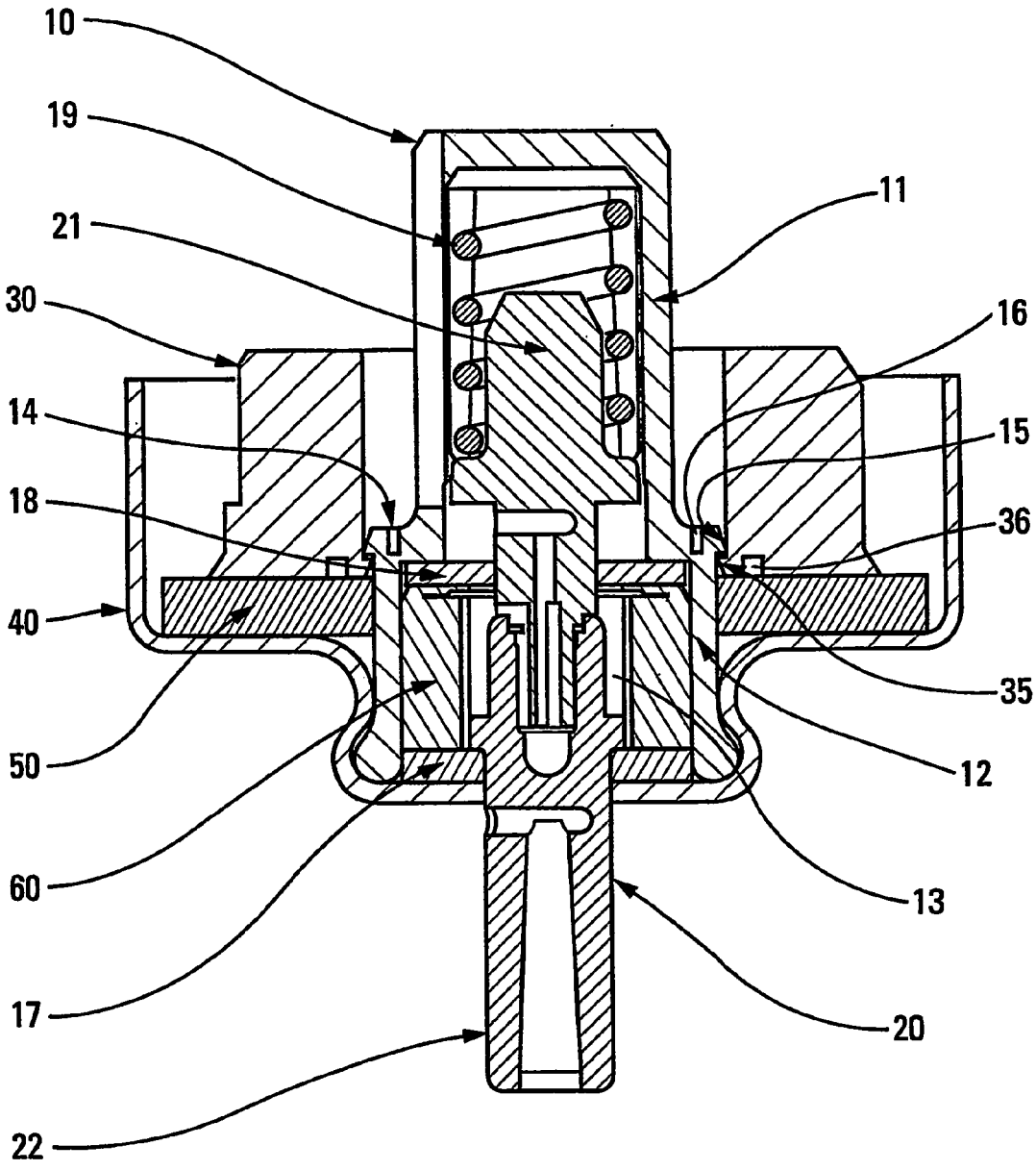

| | | | | |
|---|---|---|---|---|
| EP | 1145987 | A1 | * | 10/2001 |
| FR | 2450758 | A1 | | 10/1980 |
| FR | 2738557 | A1 | * | 3/1997 |
| GB | 1358498 | A | * | 7/1974 |
| GB | 2206099 | A | * | 12/1988 |
| WO | WO8705279 | A | * | 9/1987 |

* cited by examiner

FLUID PRODUCT DISPENSING VALVE AND FLUID PRODUCT DISPENSING DEVICE COMPRISING SAME

This invention concerns an improved valve. More particularly, this invention concerns an improved valve comprising an annular ring assembled around the valve body.

Valves are well known in the state of the art. Their main application is in aerosol recipients for dispensing fluid products together with a propelling gas. The valve comprises a valve body which is fixed in an attachment element, such as a crimpable capsule or similar, designed to fix the valve to a container with a neck seal positioned between them designed to create a seal with the container. In some situations, the product in the container may be incompatible with the seal materials. In this way, certain pharmaceutical, perfume or cosmetic products, as well as insecticides, etc. may contain constituents that can react with the seals which may absorb or fix these constituents and swell, crack or suffer damage. The recipient may leak as a result. There may also be exchanges between the seal and the product, causing the product to lose its qualities. Similarly, cases of an active product being fixed on the seal may also be observed. As the containers may remain a certain length of time in storage or on the shelf, these disadvantages may be serious, even if the reaction with the seal is not rapid.

To overcome this problem, the use of an annular ring assembled around the valve body has been proposed, designed to limit the contact between the seal and the product as much as possible. The document FR-2 450 758 describes such a ring. The use of this ring provides among others the advantage of substantially filling the dead space situated below the product inlet opening in the valve body, in the in-use position of said valve, when this concerns a valve that may be used in the inverted position. In this way, this guarantees that the maximum amount of product is dispensed due to this dead space being limited. The document FR-2 738 557 describes a similar annular ring, and which substantially fulfils the same objectives as that of the document FR-2 450 758. The specific design of the ring of the document FR-2 738 557 provides additional advantages, by limiting further the contact between the seal and the product, by permitting the manufacturing tolerances to be compensated, and also by preventing the sedimentation residues that may occur with valves used in the inverted position from being distributed.

The annular rings described above are sleeved onto the valve body, the radial clamping being sufficient to hold said ring in position. This embodiment has certain disadvantages however. The radial clamping of the ring on the valve body is likely, over the time, to deform said valve body, such that the clamping may no longer be sufficient to hold the ring in position, and it could then slide out of position along the valve body, such that it could no longer achieve the objectives that it has been designed for. Furthermore, the deformation of the valve body is likely to cause a risk of the valve stem jamming. This is especially true in the case of dosing valves, in which the valve body contains a dosing chamber and a valve stem moving between a rest position and an actuated position. This valve stem has pressure applied by a spring to bring it back to its rest position, and when the user actuates the dosing valve, he presses on this valve stem which moves inside the valve body to the actuated position in which a dose of the product is expulsed. The spring then brings the valve stem rod back to its rest position. To obtain maximum performances from the dispensing valve, the clearance between the stem, in particular its lower, internal section, and the valve body, is precisely designed so as to provide the best performances. In this case, a slight deformation of the valve body, in particular the part of the valve body in which the lower part of the stem moves, risks to make the latter jam, and consequently cause the valve to dysfunction. The risk of deformation of the valve body is even greater if it has several large sized openings, to allow the product to enter from the container inside the valve. In particular, a valve body comprising three longitudinal slots in the side wall of the valve body implies that the valve body has to be relatively flexible, which is incompatible with radial clamping of the annular ring on this valve body.

An objective of this invention is to provide a valve which does not reproduce the above-mentioned disadvantages.

In particular, one purpose of this invention is to provide a dispensing valve for fluid products that is safe and reliable in its operation, by substantially eliminating the risk of the valve stem jamming when it is actuated.

Another objective of this invention is to provide such a valve comprising an annular ring around the valve body that is simple and inexpensive to manufacture and assemble.

Another objective of this invention is to provide such an improved valve, in which there are no risks of the annular ring assembled around the valve body moving out of position during its working life.

An objective of this invention is therefore a dispensing valve for fluid products, comprising a valve body, a valve stem moving in said valve body between a rest position and a dispensing position, and an annular ring mounted around said valve body, characterised in that said annular ring is attached on said valve body, said attachment being substantially radially not clamping onto said valve body, said annular ring comprising a axial edge proximal to the outlet orifice of said valve, said annular ring comprising one or more attachment means co-operating with the valve body and provided on or next to said proximal axial edge.

Advantageously, the annular ring is snap-fitted onto the valve body.

According to one advantageous embodiment of this invention, the valve body comprises a first part of the body, in which slides an internal part of the valve stem, and a second part of the body, defining a dosing chamber, the second part of the body having an external diameter greater than that of the first part of the body, said first and second parts of the body being connected by a junction part, said annular ring being attached to said valve body at the level of said junction part.

Advantageously, the valve body comprises one or more body snap-fit means co-operating with one or more ring snap-fit means provided on the annular ring.

Advantageously, said body snap-fit means comprise at least one shoulder provided in the external lateral wall of said valve body.

Advantageously, said ring snap-fit means comprise at least one shoulder provided in the internal lateral wall of said annular ring.

Advantageously, said body and/or ring snap-fit means have radial deformation means.

Advantageously, said radial deformation means comprise a radial space positioned radially respectively behind said body and/or ring snap-fit means.

Advantageously, said annular ring comprises a radial recess positioned axially behind said ring snap-fit means.

Advantageously, the annular ring is attached to the valve body with radial and/or axial clearance.

Another objective of this invention is a valve unit characterised in that it comprises a valve as described above, an attachment element to attach said valve to a fluid product container and a seal to make said container leak proof, said seal being positioned between said attachment element and said annular ring.

Another objective of this invention is a fluid product dispensing device, comprising a container of fluid product and a valve unit as described above.

Figure 2:
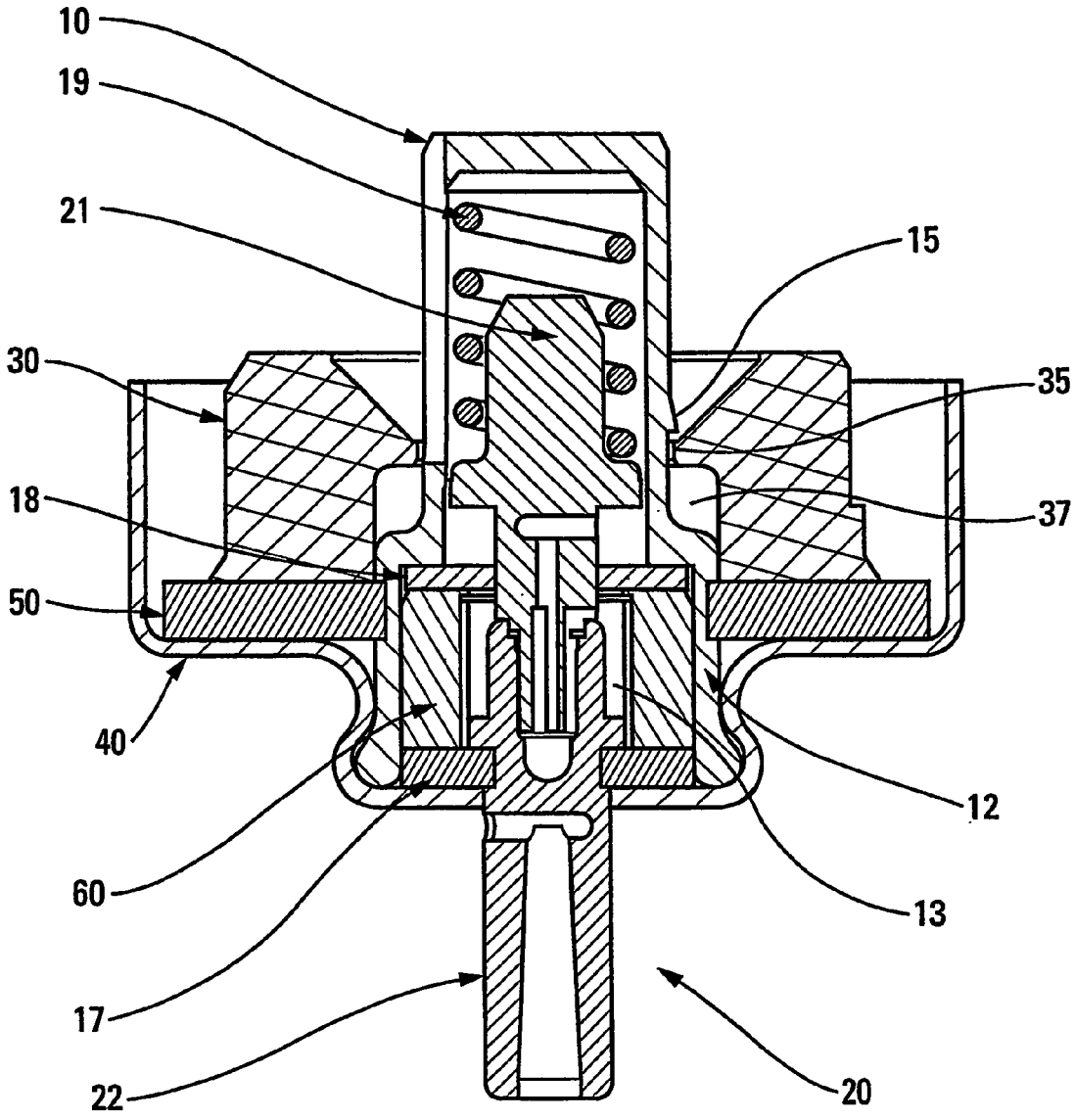

Other characteristics and advantages will become clearer in the following description of two advantageous embodiments of the invention, made in reference to the appended drawings, provided by way of non-restrictive example, and in which:

FIG. 1 represents a schematical cross sectional view of a valve according to one advantageous embodiment of this invention, in the rest position, and FIG. 2 shows another embodiment.

In reference to the figures, the valve comprises a valve body 10, inside which a moving valve stem 20 slides between a rest position, represented on the figures, and a dispensing position, in which the valve stem is pressed inside the valve body. Traditionally, the valve stem has an outlet orifice via which the product is dispensed. An annular ring 30 is mounted around said valve body 10 and, according to the invention, the annular ring 30 is fixed in substantially loose or non-clamping to the valve body 10, that is the ring 30, when assembled, exerts only little or no radial force on valve body 10. The risk of deformation of said valve body due to the presence of the ring 30 is therefore eliminated. The ring may be attached to the valve body with a radial and/or axial clearance, which means that the ring, when it is fixed, is in fact held on the valve body, without necessarily being blocked in position. Preferably, the annular ring 30 is fixed to the valve body 10 by a snap-fit. This snap-fit may be in different forms, for example with or without clearance, the attachment or snap-fit means may be provided on the valve body, 10, on the annular ring 30 or on both, as shown in the drawings. More precisely, the valve body 10 may comprise one or more body attachment or snap-fit means 15, preferably in the form of one or more shoulders made in the external lateral wall of said valve body 10. Similarly, the annular ring 30 may also comprise one or more ring attachment or snap-fit means 35, preferably in the form of one or more shoulders made in the internal lateral wall of the ring 30. Advantageously, the respective snap-fit means 15, 35, of the valve body 10 and the annular ring 30 may comprise angled ramps to facilitate the snap-fit operation.

Advantageously, as shown in FIG. 1, the ring attachment means 35 are made on or next to the lower axial edge of the ring 30, in the position shown in FIG. 1. This lower axial edge corresponds to the proximal axial edge of the ring 30, with respect to the outlet orifice of the valve 20. To facilitate the attachment, and in particular the snap-fit, radial deformation means 16, 36, may be provided on said attachment means of the body 15 and/or on said attachment means of the ring 35. More precisely, as shown in FIG. 1, these deformation means may be made in the form of a respective radial space 16, 36, positioned radially behind said shoulder 15 of the valve body 10 and/or behind said shoulder 35 of the annular ring 30. In the example shown in FIG. 1, the ring 30 is fastened by clips or snap-fit when assembled by exerting a radial deformation force on the snap-fit means, which can deform radially due to the presence of the two respective spaces 16 and 36, and subsequently return to their normal position due to their elasticity. In the example shown in FIG. 2, the ring 30 is also fastened by clips or snap-fit when assembled. In this example, only the ring snap-fit means 35 deform radially when fixed. Contrarily to the example in FIG. 1, the shoulder is not formed at the lower edge of the ring 30. It may be formed by a projection 35 forming a shoulder, and the ring 30 may have a radial recess 37 positioned axially behind said projection 35, in particular to limit the contact surface between the ring 30 and the valve body. The ring 30 is therefore attached to a part that is axially more internal of the valve body.

Consequently, in the assembled position shown in the figures, the ring 30 is attached definitively onto the valve body 10, and in particular it does not risk moving during the working life of this valve, for example due to deformation of the valve body 10 as was the case in the devices of the prior art. One advantage of the snap-fit is that when assembled, the radial ring 30 may only exert a very low radial force on the valve body, or even no radial force at all.

Classically, the valve may be held on the neck of a container (not shown) by means of an attachment element 40, for example made in the form of a capsule or a cup that may be crimped. Of course, other attachment elements may be envisaged to attach it. The valve is attached to the container with a seal 50 placed between them, called the neck seal. Advantageously, the ring 30 is, in the assembled position, applied against said neck seal 50, which is consequently blocked between the annular ring 30 and the attachment element 40. In this way, the presence of the ring 30 limits the contact between the product inside the container and the neck seal 50. Preferably, it is the proximal axial edge of the ring 30 that is in contact with the seal 50. Advantageously, the ring 30 is made from an inert material with respect to the product contained in the container, and permits all of the previously mentioned functions of the rings to be satisfied, as defined in the above mentioned documents of the prior art, which is to say the patents FR-2 450 758 and FR-2 738 557.

One advantage of this invention is the possibility of making a valve unit formed by the valve itself, the attachment element 40 and the seal 50. This valve unit may then be supplied to the manufacturer of the product who consequently simply has to fill the product in a container and assemble the valve unit on said container by means of the attachment element 40.

This invention applies to all types of valve, and especially those which operate in the inverted position, but it has additional advantages in the context of a dosing valve as shown in the drawings.

In reference to these drawings, the dosing valve comprises a valve body 10, which contains a dosing chamber 13. This dosing chamber 13 is limited axially by two annular seals, a valve seal 17 and a chamber seal 18. These two seals each have a central opening through which a valve stem 20 passes, moving inside the valve body 10 between a rest position, shown in the drawings, and an actuating position. This valve stem is urged towards its rest position by an elastic element 19, such as a spring, thrusting on the one hand on the base of the valve body 10 and on the other hand on an internal part 21 of the valve stem 20. As this type of dosing valve is known, its operation will not be described in fuller detail hereinafter.

The valve body 10 is attached, especially crimped in an attachment element 40, such as a capsule, which is then attached, for example by crimping, to the neck of any container (not shown) with a neck seal 50 being placed between them.

Advantageously, the valve body 10 comprises a first body part 11, in which the internal part 21 of the valve stem 20 slides, and a second body part 12, which comprises the dosing chamber 13. This dosing chamber 13 may possibly be formed by a sleeve 60 inserted in the second body part 12. As shown in the drawings, the second body part 12 preferably has an external diameter that is greater than that of the first body part 11, said first and second body parts, 11, 12, being joined by a junction part 14. In the embodiment shown in FIG. 1, the annular ring 30 is attached to said valve body 10 at the junction part 14. More precisely, as shown in FIG. 1, this junction part 14, which may be formed by a part of a radial or conical wall section, comprises body snap-fit means 15, which co-operate with the snap-fit means 35 of the ring 30. In this way, the ring does not co-operate at all with the first body part 11, in which the internal part 21 of the valve stem 20 slides. This is especially advantageous in the case of a dosing valve in which the first body part 11 comprises one or more longitudinal slots running along the greater part of its lateral wall, to permit the product stored in the container (not shown) to enter inside the valve. The presence of one or more slots of this type induces a certain flexibility of the valve body 10, such that even a low radial force exerted on the first body part 11 would risk deforming it. Whereas, in efficient dosing valves, the clearance provided between the internal wall of the valve body 10 and the valve stem 20 is generally determined very precisely such that even a slight deformation of the valve body risks jamming the valve stem and therefore causing the valve to dysfunction. The internal diameter of the valve body is not deformed and therefore does not vary over the time, which consequently permits any risk of jamming to be avoided whilst permitting the use of an annular ring 30 with the above mentioned advantages and functions.

In the example shown in FIG. 2, the shoulder(s) 15 of the valve body 10 is/are made in the first body part 11. In this case, it is preferable that the radial force exerted on the valve body by the ring 30 is minimal, or even non-existent, to avoid any risk of deformation of said valve body;

This invention has been described in reference to an advantageous embodiment of it, however it is clear that it is not restricted to this embodiment. On the contrary, those skilled in the art may make many modifications without leaving the scope of this invention as defined in the appended claims.

The invention claimed is:

1. Fluid product dispensing valve, comprising a valve body (10), a valve stem (20) moving in said valve body (10) between a rest position and a dispensing position, and an annular ring (30) mounted around said valve body (10), characterised in that said annular ring (30) is attached to said valve body (10) in a substantially radially non-clamping manner and substantially loosely onto said valve body (10), said annular ring (30) comprising a proximal axial edge that is proximal with respect to an outlet orifice of said valve stem (20), and a distal axial edge that is distal with respect to the outlet orifice of said valve stem (20), said annular ring (30) comprising one or more attachment means (35) co-operating with the valve body (10) and provided closer to said proximal axial edge than to said distal axial edge, in which the annular ring (30) is snap-fitted onto the valve body (10).

2. Valve according to claim 1, in which the valve body (10) comprises a first body part (11), in which an internal part (21) of the valve stem (20) slides, and a second body part (12), defining a dosing chamber (13), the second body part (12) having an external diameter greater than that of the first body part (11), said first and second body parts (11, 12) being joined by a junction part (14), said annular ring (30) being attached to the valve body (10) at said junction part (14) or at said second body part (12).

3. Valve according to claim 1, in which the valve body (10) comprises one or more body snap-fit means (15) co-operating with one or more ring snap-fit means (35) provided on the annular ring (30).

4. Valve according to claim 3, in which said body snap-fit means (15) comprise at least one shoulder (15) provided in the external lateral wall of said valve body (10).

5. Valve according to claim 3, in which said ring snap-fit means (35) comprise at least one shoulder (35) provided in the internal lateral wall of said annular ring (30).

6. Valve according to claim 3, in which said body snap-fit means (15) and/or said ring snap-fit means (35) comprise radial deformation means (16, 36).

7. Valve according to claim 6, in which said radial deformation means (16, 36) comprise a radial space (16, 36) respectively positioned radially behind said body (15) and/or ring (35) snap-fit means.

8. Valve according to claim 3, in which said annular ring (30) comprises a radial recess (37) positioned axially behind said ring snap-fit means (35).

9. Valve according to claim 1, in which said annular ring (30) is attached to said valve body (10) with a radial and/or axial clearance.

10. Valve unit, characterised in that it comprises a valve according to any of claim 1, an attachment element (40) to attach said valve to a container of fluid product and a seal (50) to make the seal with said container, said seal (50) being positioned between said attachment element (40) and said annular ring (30).

11. Fluid product dispensing device, characterised in that it comprises a fluid product container and a valve unit according to claim 10.

12. A valve according to claim 1, wherein the annular ring is loosely attached to the valve body so that the annular ring exerts substantially no radial clamping force on the valve body.

13. A dispensing valve comprising:

a valve body;

a valve stem moving in the valve body; and an annular ring comprising a proximal axial edge that is proximal with respect to an outlet orifice of the valve stem and a distal axial edge that is distal with respect to the outlet orifice of the valve stem, said annular ring being mounted around said valve body;

wherein the annular ring is attached to the valve body in a substantially non-clamping manner in a radial direction of the annular ring;

wherein the annular ring is attached to the valve body closer to said proximal axial edge than to said distal axial edge; and wherein the annular ring is attached to the valve body through a snap-fit.

14. A dispensing valve according to claim 13, wherein the valve body and the annular rings each comprise a shoulder and a radial space positioned radially behind the shoulder and the shoulders communicate to achieve the snap-fit.

15. A dispensing valve according to claim 13, wherein the annular ring is attached to the valve body with at least one of a radial or an axial clearance.

16. A dispensing valve according to claim 13, wherein the annular ring is loosely attached to the valve body.

17. A dispensing valve comprising:

a valve body;

a valve stem moving in the valve body; and an annular ring mounted around said valve body;

wherein the annular ring is attached to the valve body in a substantially non-clamping manner and substantially loosely;

wherein the annular ring is attached to the valve body at an axial edge that is proximal with respect to an outlet orifice of the valve stem;

wherein the valve body comprises a first body part in which an internal part of the valve stem slides, and a second body part defining a dosing chamber; and wherein the annular ring is attached to the valve body through a snap-fit.

18. A valve according to claim 17, wherein the second body part has an external diameter greater than that of the first body part.

19. A valve according to claim 18, wherein said first and second body parts are joined by a junction part; and wherein the annular ring is attached to the valve body at least one of the junction part or the second body part.

* * * * *